United States Patent [19]

Pryor

[11] Patent Number: 4,525,385

[45] Date of Patent: Jun. 25, 1985

[54] APPLICATION OF ADDITIVES TO CIGARETTE FILTER TOW

[75] Inventor: James W. Pryor, Winston-Salem, N.C.

[73] Assignee: R. J. Reynolds Tobacco Company, Winston-Salem, N.C.

[21] Appl. No.: 622,964

[22] Filed: Jun. 21, 1984

Related U.S. Application Data

[62] Division of Ser. No. 468,011, Feb. 18, 1983, Pat. No. 4,476,807.

[51] Int. Cl.[3] ..... B05D 3/12; B05D 1/02

[52] U.S. Cl. ..... 427/177; 19/66 T; 427/389.9; 427/255.5; 427/421; 427/424

[58] Field of Search ..... 427/421, 424, 255.5, 427/177, 389.9; 19/66 T; 118/317, 325, 326, 303

[56] References Cited

U.S. PATENT DOCUMENTS

| | | | |
|---|---|---|---|
| 2,379,824 | 7/1945 | Mummery | 19/66 T |
| 2,657,433 | 11/1953 | Merriman | 19/66 T |
| 2,697,022 | 12/1954 | Moos et al. | 19/66 T |
| 2,805,640 | 9/1957 | Davis et al. | 118/326 |
| 2,966,198 | 12/1960 | Wylde | 154/17 |
| 3,050,430 | 8/1962 | Gallagher | 156/166 |
| 3,099,594 | 7/1963 | Caines et al. | 156/152 |
| 3,106,501 | 10/1963 | Cobb, Jr. et al. | 156/180 |
| 3,144,025 | 8/1964 | Erlich | 19/66 T |
| 3,226,773 | 1/1966 | Paliyenko | 118/325 X |
| 3,262,178 | 7/1966 | Aspy, Jr. et al. | 19/66 T |
| 3,262,181 | 7/1966 | Hawkins et al. | 28/72 |
| 3,282,768 | 11/1966 | Caines et al. | 156/441 |
| 3,297,506 | 1/1967 | Pannill, Jr. et al. | 156/152 |
| 3,306,254 | 2/1967 | Keith | 118/227 |
| 3,323,961 | 6/1967 | Gallagher | 156/180 |
| 4,132,189 | 1/1979 | Greve et al. | 118/325 X |

*Primary Examiner*—Thurman K. Page
*Attorney, Agent, or Firm*—Herbert J. Bluhm

[57] ABSTRACT

A filter tow blooming jet device for applying an additive to a continuous, multifilament filter tow is disclosed wherein the jet device is provided with orifice means transversely positioned in an elongated passageway through which the advancing filter tow passes and the additive is applied by nozzle means concentrically positioned with respect to the advancing filter tow at a point downstream of the orifice means. The additive may also be applied to the filter tow by nozzle means positioned adjacent to the wall surface of the elongated passageway or by injecting the additive into a stream of gaseous fluid introduced into the jet device for blooming the filter tow.

13 Claims, 10 Drawing Figures

APPLICATION OF ADDITIVES TO CIGARETTE FILTER TOW

This is a divisional of co-pending application Ser. No. 468,011 filed on Feb. 18, 1983 and now U.S. Pat. No. 4,476,807.

TECHNICAL FIELD

This invention relates to the application of additives to cigarette filter tow in connection with the formation of filter rods suitable for use in the manufacture of cigarettes.

BACKGROUND ART

The manufacture of cigarette filters from a continuous, multifilament filter tow generally involves processing steps which include the opening up of the tow or separation of the individual filaments, the application of plasticizer or other additives to the opened up tow and the formation of a continuous filter rod from the treated filter tow. The uniformity and filtering characteristics of the resulting filter rod are largely determined by the effectiveness of these tow processing steps. Thus, there is a substantial amount of prior art which is directed to methods and apparatus for transforming filter tow into cigarette filters having predictable smoke filtration characteristics.

U.S. Pat. No. 2,966,198 discloses a method and apparatus for processing filter tow wherein unopened tow is passed through a cylindrical tube in which the tow is subjected to a turbulent air stream and a spraying treatment with an aqueous solution of a cellulose derivative. That method and apparatus, however, do not lead to a filter rod that has acceptable uniformity because the turbulent air zone provided is insufficient to open up the tow before the tow is sprayed with the aqueous treating solution. This is due in part to the fact that the turbulent air stream is introduced at a point immediately upstream of the spraying device. The result is an uneven distribution of treating solution on the advancing tow. Also, the apparatus design is such that substantial quantities of compressed air are required to maintain the turbulence in the turbulent air zone.

Other methods and apparatus for treating filter tow with an air stream in tow confining means having substantially circular cross-sectional configurations are disclosed in U.S. Pat. Nos. 3,099,594, 3,262,181, 3,282,768 and 3,297,506. In each of these patents a continuous, multifilament filter tow is passed through a jet tube containing orifice means where the tow is combined with an air stream at elevated pressures. The combined filter tow/air stream emerges from the confining walls of the tubular member into an exit member which allows the elevated pressures to dissipate rapidly thereby causing the filter tow to be bloomed. Of particular interest is an alternative embodiment shown in FIG. 5 of U.S. Pat. No. 3,282,768 wherein plasticizer is injected into the tow blooming apparatus via a capillary tube probe terminating at the orifice means positioned in the jet tube. Injection of plasticizer at this point, however, is completely unsatisfactory because the filter tow emerging from the orifice means has not yet assumed an expanded or "opened up" configuration due to the action of the air stream. This results in plasticizer being applied only to the tow fibers immediately surrounding the capillary tube probe and the air currents associated with the filter tow downstream from the orifice means are unable to promote uniform redistribution of the plasticizer throughout the tow. When capillary tube probes are positioned at the inner wall surface of the jet tube as shown in FIG. 5 of U.S Pat. No. 3,282,768, there is a similar inability of the air stream to effect uniform redistribution of plasticizer throughout the filter tow. Unless the quantity of plasticizer flow to the capillary tube probes is carefully controlled and limited, there is a tendency for droplets of plasticizer to collect on the inner wall surface of the jet tube and to move under the influence of the air stream to the exit end of the jet tube where the plasticizer drips from the apparatus. The problems in achieving satisfactory operation of this alternative embodiment are apparently appreciated by the patentees in that the preferred apparatus embodiment disclosed in FIG. 6 of U.S. Pat. No. 3,282,768 employs wick type applicators for applying plasticizer to a flattened band of filter tow before the tow is introduced into the jet blooming device. In fact, the most widely used commercial methods for applying plasticizer to filter tow in the manufacture of cigarette filters currently involve the application of plasticizer to a flat band or web of the filter tow.

BRIEF SUMMARY OF THE INVENTION

This invention provides an improved method and apparatus for applying an additive to a continuous multifilament filter tow in conjunction with the manufacture of cigarette filters from the tow.

It is a principal object of this invention to provide a method and apparatus for applying uniform amounts of an additive to a continuous, multifilament filter tow while the filter tow is in a loosely compacted, substantially circular cross-sectional configuration.

It is a further object of this invention to provide a method and apparatus for applying precisely controlled amounts of an additive to a continuous, multifilament filter tow while the filter tow is being moved by a gaseous fluid in a longitudinal direction through a treating zone, said amounts being precisely controllable even at extremely low levels of application.

Other objects and advantages of the invention will be apparent from the detailed description which follows.

DETAILED DESCRIPTION OF THE INVENTION

Figures 1, 1A:
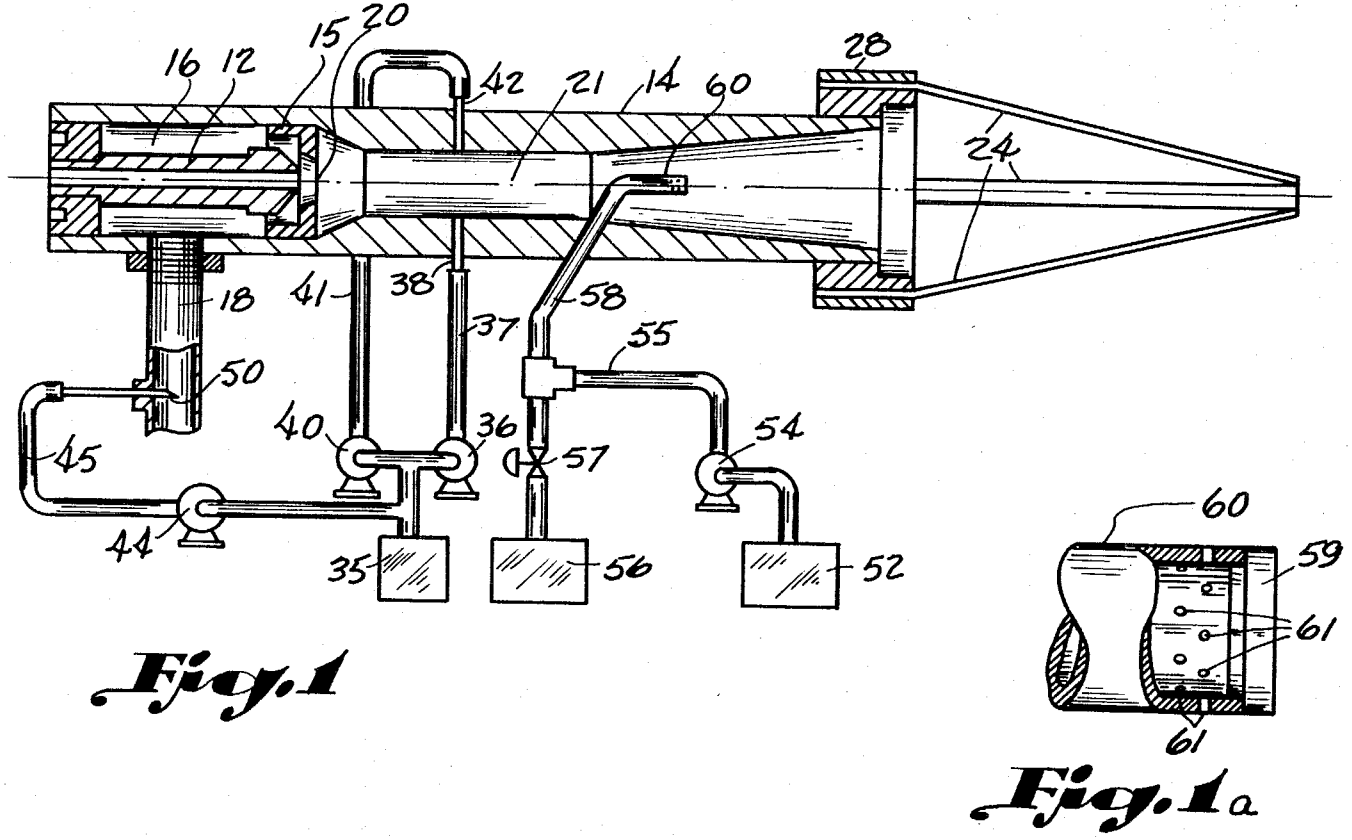
FIG. 1 is a cross-sectional view of a jet device modified in accordance with the present invention.
FIG. 1*a* is a perspective view, partially in section, showing the detailed construction of one of the nozzles in the FIG. 1 device.

The present invention provides an improved method and apparatus for applying an additive to a continuous, multifilament filter tow in connection with the manufacture of filter elements therefrom. This invention involves passing the filter tow through a jet device that is provided with means for subjecting the filter tow to a high velocity flow of gaseous fluid which opens and blooms the tow. As the filter tow moves through the jet device, one or more additives are applied to the tow by nozzle means which are strategically located.

The basic design of the jet device is more or less conventional and includes (a) a jet tube having entry and exit ends with an elongated passageway substantially circular in cross-sectional shape extending through the tube, the entry and exit ends being adapted to receive and discharge, respectively, a continuous, multifilament filter tow, (b) a tubular tow entrance member aligned with and concentrically extending a short distance into the entry end of the jet tube to a termination point and defining an annular chamber between the tubular tow entrance member and the wall of the elongated passageway, (c) means for introducing a gaseous fluid into the annular chamber defined by the tubular tow entrance member and the wall of the elongated passageway and for maintaining a high velocity flow of the gaseous fluid through the jet device in the direction of the exit end of the jet tube, (d) orifice means transversely positioned in the elongated passageway adjacent to the termination point of the tubular tow entrance member and designed to accommodate passage therethrough of gaseous fluid and filter tow introduced into the jet device, (e) discharge means disposed at the exit end of the jet tube and designed to permit a sudden radially outward movement of gaseous fluid and filter tow as they emerge from the exit end of the jet tube, and (f) tow confining means associated with the discharge means for limiting the radially outward movement of the filter tow.

In addition to the features of the jet device enumerated above, the jet device is also provided with primary nozzle means for applying an additive to the filter tow as it moves through the jet tube. The location of the primary nozzle means is important if the objects of the present invention are to be achieved. It has been found that the additive can be deposited principally on filaments located in the interior portions of the filter tow bundle if the primary nozzle means are concentrically positioned with respect to the advancing filter tow in the elongated passageway of the jet tube at a point that is downstream (i.e., in the direction of the exit end of the jet tube) of the orifice means. The primary nozzle means are, therefore, circumferentially surrounded by the loosely compacted filter tow during normal operation of the jet device. The degree of additive distribution can be influenced by the nozzle design used. For example, a nozzle provided with gas-atomizing means and designed to direct the spray in a pattern that is substantially perpendicular to the direction of movement of the filter tow gives a more diffuse distribution of additive than a pressure nozzle similarly positioned but directing its spray in a pattern that is substantially parallel to the longitudinal axis of the advancing filter tow. Preferably, the primary nozzle means are located downstream from the orifice means at a distance that is equal to at least half the distance from the orifice means to the exit end of the jet tube. The primary nozzle means may also be concentrically positioned adjacent to the exit end of the jet tube.

Since the primary nozzle means concentrically positioned with respect to the advancing filter tow results in additive deposition principally on the filaments located in the interior portions of the filter tow bundle, it is desirable to employ additional means for applying additive to the filaments in the outer periphery of the filter tow bundle. This is particularly true when the additive being applied is a plasticizing agent for the filter tow and the formed filter rod is not enveloped by a paper wrap. The additional means may comprise the application of additives by conventional means to a flattened band of the filter tow prior to its entry into the jet device. Alternatively, additives may be injected into the stream of gaseous fluid which flows through the jet device. Preferably, the additive is injected by secondary nozzle means located at a point that is upstream to the orifice means but such secondary nozzle means may also be positioned adjacent to the wall surface of the elongated passageway in the jet tube at a point that is downstream of the orifice means. When additive is injected at either of these points by the secondary nozzle means, the distribution of additive occurs largely in the outer peripheral filaments of the filter tow bundle. By using a combination of additive injection at either of these points via the secondary nozzle means with additive injection via concentrically positioned primary nozzle means, it is possible to achieve adequate distribution of additive on the filter tow to give a uniformly treated filter rod. Thus, the need for applying additives such as plasticizers in the conventional manner (i.e., application to a flattened band of filter tow) is unnecessary if a combination of additive injection in the jet device is employed.

Although injection of additives via the primary and secondary nozzle means results in additive deposition principally in the interior portions and outer peripheral portions, respectively, of the filter tow bundle, the location of the additive-treated filaments in the subsequently formed filter rod may be influenced by the manner in which the tow is processed after it leaves the jet device. Commercial apparatus presently used employs two cooperating delivery rolls for withdrawing bloomed filter tow from the jet device and directing the tow into a condensing horn located at the entrance to the rod-forming means. As the tow passes between the delivery rolls, it is compressed and spread out into a flat band of tow before the condensing horn gathers and compacts the tow in connection with the rod-forming operation. As the condensing horn gathers the flat band of filter tow, a certain amount of folding and crumpling of the tow occurs which may influence the orientation and relative positions of individual filaments in the subsequently formed filter rod. Thus, filaments located in the outer peripheral portions of the filter tow bundle as it exits from the jet device may move to the interior portion of the formed filter rod as a result of the tow flattening and gathering action. Likewise, filaments located in the interior portions of the filter tow bundle as it emerges from the jet device may ultimately be located in the outer peripheral portions of the formed filter rod. While this translocation of filaments does not necessarily have a detrimental effect on the filtering characteristics of the formed filter rod, the perceived smoking characteristics of the filter rod may be affected if the translocated filaments carry a flavor additive that has been applied to the filter tow via the nozzle means associated with the jet device.

The effect of flavor additives incorporated into a filter rod is generally most pronounced if distribution of the flavor additives is concentrated largely along the longitudinal axis of the filter rod. Since the translocation of filaments during processing of the tow tends to render ultimate location of flavorant-treated filaments in the formed filter rod uncertain, it is desirable to modify the tow processing arrangement so that the translocation problem is minimized. By appropriate process modifications the relative location of additive-treated filaments in the formed filter rod with respect to their location in the jet device can be substantially correlated.

One process modification that minimizes the translocation of filaments involves passage of the filter tow through a stuffer jet just prior to introducing the filter tow into the rod-forming means. Stuffer jets suitable for this purpose are disclosed in U.S. Pat. Nos. 3,050,430 and 3,323,961. In this modification the bloomed substantially round filter tow bundle is withdrawn from the blooming jet device and is compressed by a pair of conventional delivery rolls and proceeds as a flattened band of filter tow into the stuffer jet where the filter tow once again assumes a substantially round, rope-like configuration due to the action of a gaseous fluid that is directed through the stuffer jet. Surprisingly, it has been discovered that filaments located in the interior portions of the filter tow bundle as it passes through the blooming jet device will be found in the interior portions of the filter tow as it emerges from the stuffer jet and enters the rod-forming means even though the tow has been temporarily compressed and flattened by the delivery rolls interposed between the blooming jet and the stuffer jet. Thus, this process modification provides a means for applying a flavor additive to the interior portions of the filter tow bundle via primary nozzle means concentrically positioned with respect to the tow in the blooming jet device and maintaining the relative location of the additive-treated filaments in the formed filter rod so that the additive is concentrated largely along the longitudinal axis of the filter rod. Conversely, flavor additives can be selectively applied to filaments which are subsequently positioned in the outer periphery of the formed filter rod by introducing the additives into the blooming jet device via secondary nozzle means arranged to apply additive to the outer peripheral filaments of the filter tow bundle.

A further process modification for minimizing the translocation of filaments employs filter tow transport means of special design. This modificaton is particularly preferred because it does not require the use of a stuffer jet which is costly to operate. The specially designed transport means comprise delivery rolls provided with a plurality of discrete tow-contacting members projecting radially outwardly from the longitudinal axis of the supporting shaft and spaced circumferentially around the periphery of the shaft. The delivery rolls are maintained in parallel, aligned juxtaposition that is close enough to engage and advance the filter tow without compressing the filter tow between directly opposed tow-contacting members. Preferably, each tow-contacting member is provided with a recessed area or indentation for engaging the tow so that the filter tow is confined to the recessed area or indentation as it traverses the feed rolls. Accordingly, these special delivery rolls are capable of withdrawing a bloomed, substantially round filter tow bundle from the blooming jet device and conveying the tow to the filter rod-forming means while retaining the substantially round, rope-like configuration of the tow. Since the substantially round, rope-like configuration of the filter tow is retained as it advances from the blooming jet device to the rod-forming means, additives applied to the interior or outer peripheral portions of the filter tow bundle as it moves through the blooming jet device will result in formed filter rods having the applied additives concentrated in their respective interior or outer peripheral portions.

The manner in which additives are supplied to the primary and secondary nozzle means in the jet device will depend somewhat on the nature of the additives. For example, plasticizers or flavoring agents may be supplied in liquid or solution form by pumps or pneumatic means. Powders, flavorant-containing microcapsules and other solid materials may be conveyed by pneumatic means. It is particularly preferred to employ combinations of flavoring agents and plasticizers because plasticizers are suitable solvents for various flavoring agents and the use of more volatile solvents is thereby avoided. Regardless of the method used for supplying additives to the nozzle means, it is important that the flow of additive from the supply source be controlled with respect to the speed of the filter tow moving through the jet device so that the desired amount of additive will be applied to the tow. Suitable equipment for conveying precise quantities of liquid or solid additive to nozzle means is commercially available and the rates at which the additives are supplied to the nozzle means may be varied over a rather broad range. Indeed, one major advantage of the present invention is that it provides excellent control of additive application to the filter tow even at very low application levels. For example, geared positive displacement pumps and conduit terminating in tubing having approximately 0.1 millimeter inside diameter can be used to apply as little as 0.15 milliliter of liquid per 100 meters of filter tow. This capability is particularly advantageous when low levels of flavoring additives are being applied to the tow.

The application of flavoring additives in liquid media at low levels is preferably accomplished via the concentrically positioned primary nozzle means. It is desirable that capillary tubing having an inside diameter between 0.1 and 0.6 millimeter be used for injecting the flavoring additives into the conduit supplying the primary nozzle means. When capillary tubing is used, filter means upstream of the capillary tubing should also be employed to prevent blockage in the capillary tubing resulting from any solid particles that may be suspended in the liquid media.

The present invention is also suited to the application of significant quantities of additives such as plasticizers which are typically applied at levels of 5 to 10 percent by weight based on the weight of the tow being treated. When plasticizer is applied to the tow, it is advisable to limit the quantity applied via the secondary nozzle means to approximately 5 percent by weight based on the weight of tow being treated in order to avoid exceeding the capacity of the gaseous fluid to effect distribution of the plasticizer into the loosely compacted filter tow.

One embodiment of the present invention is shown in FIG. 1. The jet device depicted therein includes jet tube 14 having elongated passageway 21 extending therethrough. The entry end of jet tube 14 is provided with tubular tow entrance member 12 through which filter tow is introduced into the jet tube. Disposed adjacent to the exit end of tubular tow entrance member 12 is orifice plate 15. Annular chamber 16 is adapted to receive a high velocity stream of air or other gaseous fluid at elevated pressures via conduit 18. Orifice 20 in orifice plate 15 is aligned with the longitudinal axes of tubular tow entrance member 12 and elongated passageway 21 so that the filter tow and gaseous fluid may pass through orifice 20 and proceed towards the exit end of jet tube 14. Discharge means 28 affixed to the exit end of jet tube 14 are provided with tow confining means including a plurality of resilient fingers 24. The portion of the elongated passageway 21 adjacent the exit end of the jet tube is preferably frustum-shaped. Additive from supply tank 35 may be injected into elongated passageway 21 via probes 38 and 42 and their respective associated conduits 37 and 41 and pumps 36 and 40. Alternatively or in addition, additive may be injected into conduit 18 via probe 50 and associated conduit 45 and pump 44. Preferably, additive from supply tank 52 is introduced into elongated passageway 21 via pump 54, conduits 55 and 58 and nozzle 60. The additive so introduced may optionally be atomized by a gaseous fluid from pressurized gas supply 56 by directing gas into conduit 58 via valve 57. The detailed construction of nozzle 60 is shown in FIG. 1*a*. Plug 59 seals off the end of conduit 58 and one or more rows of holes 61 are circumferentially arranged around the periphery of conduit 58 adjacent plug 59. The additive is forced through the holes 61 to give a substantially radial spray pattern.

Figure 2:
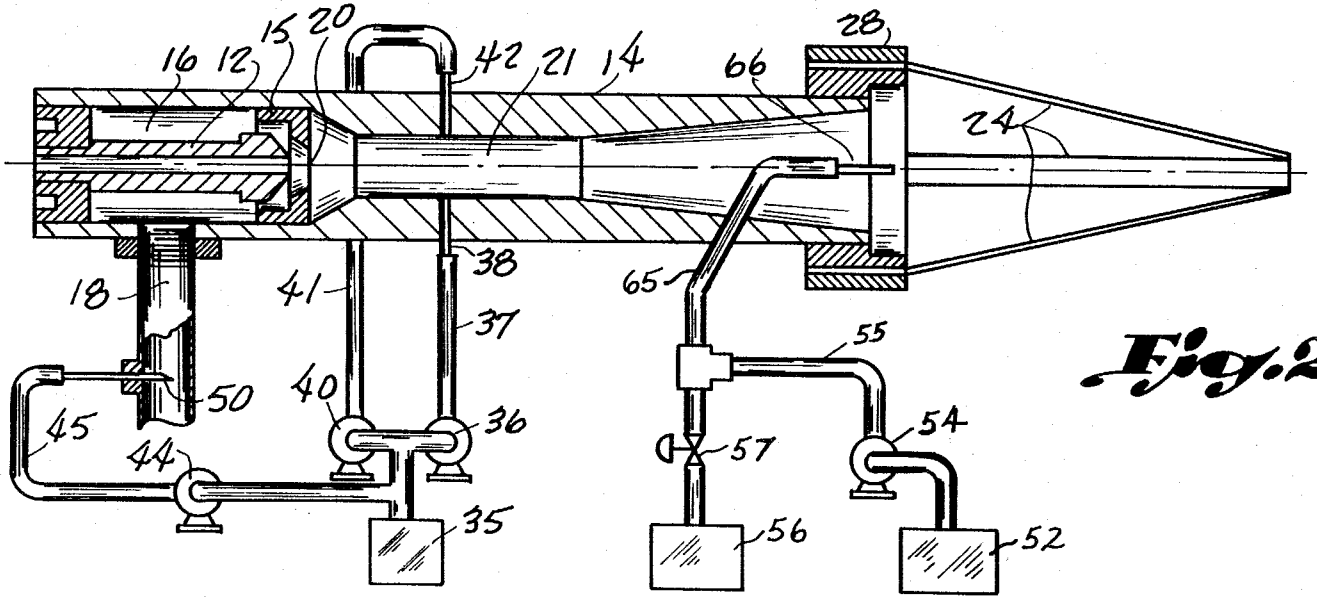
FIG. 2 is a cross-sectional view of a jet device showing another embodiment of the present invention.

Shown in FIG. 2 is a jet device having the same basic design as that shown in FIG. 1 and the various elements which are the same in each case have been assigned similar identifying numbers. In FIG. 2 additive is applied to the interior portion of the filter tow by conduit 65 and probe 66 which is concentrically positioned within discharge means 28. Probe 66 is preferably a pressure type nozzle which directs a narrow stream of additive at the bloomed filter tow. The resulting treated filter tow exhibits a somewhat more concentrated additive distribution pattern than that obtained with the nozzle arrangement shown in FIG. 1 and FIG. 1*a*.

Figure 3:
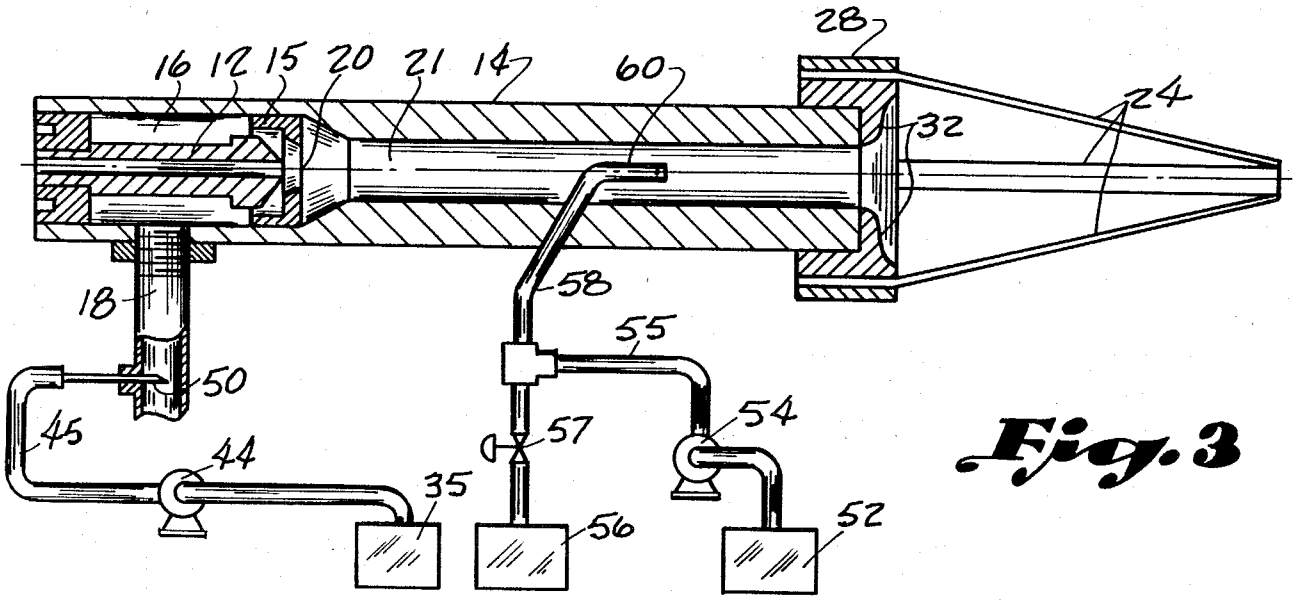
FIG. 3 is a cross-sectional view of a jet device showing yet another embodiment of the present invention.

The jet device shown in FIG. 3 is similar to that of FIG. 1 except for certain modifications associated with the exit end of the jet tube. The frustum-shaped portion of elongated passageway 21 shown in FIG. 1 has been eliminated and the substantially cylindrical passageway 21 terminates at the exit end of the jet tube and abuts fillet 32 disposed on the inside wall of discharge means 28. Fillet 32 provides a smooth streamlined surface connecting the inside wall of the exit end of the jet tube with the inside wall of the discharge means. The presence of fillet 32 eliminates "dead space" where additive dislodged from the outer peripheral portion of the filter tow by the expanding gaseous fluid tends to accumulate.

Figure 4:
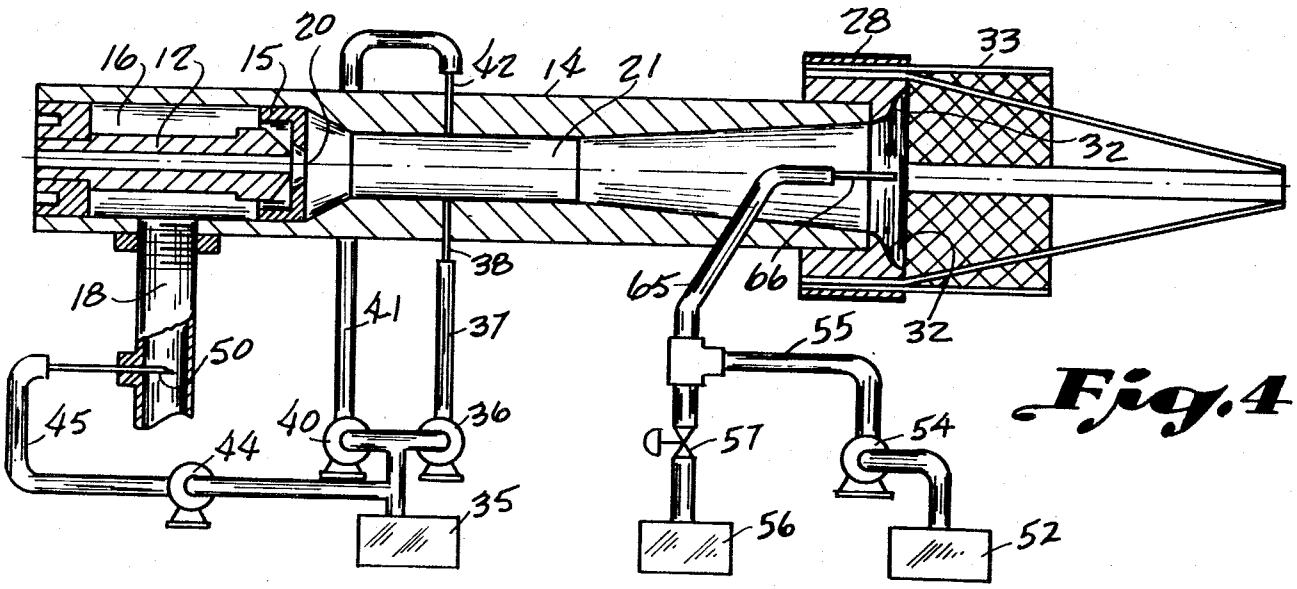
FIG. 4 is a cross-sectional view similar to that of FIG. 2 but showing certain modifications in the area where the filter tow exits from the device.

FIG. 4 shows yet another preferred embodiment which is similar to that of FIG. 2 except for modifications associated with discharge means 28. Fillet 32 provides a smooth streamlined surface for the expanding filter tow as it emerges from elongated passageway 21. Cylindrical sleeve 33 is axially aligned with and is attached to discharge means 28. Cylindrical sleeve 33 restricts the radially outward movement of the filter tow in the areas between resilient fingers 24 but allows at least a portion of the gaseous fluid to escape through the sleeve as the tow is bloomed by the expanding gaseous medium. Preferably, sleeve 33 is constructed of screen wire, perforated metal or plastic or other suitable porous material that is essentially rigid but free of any sharp protrusions which might interfere with the forward movement of the tow.

Figure 5:
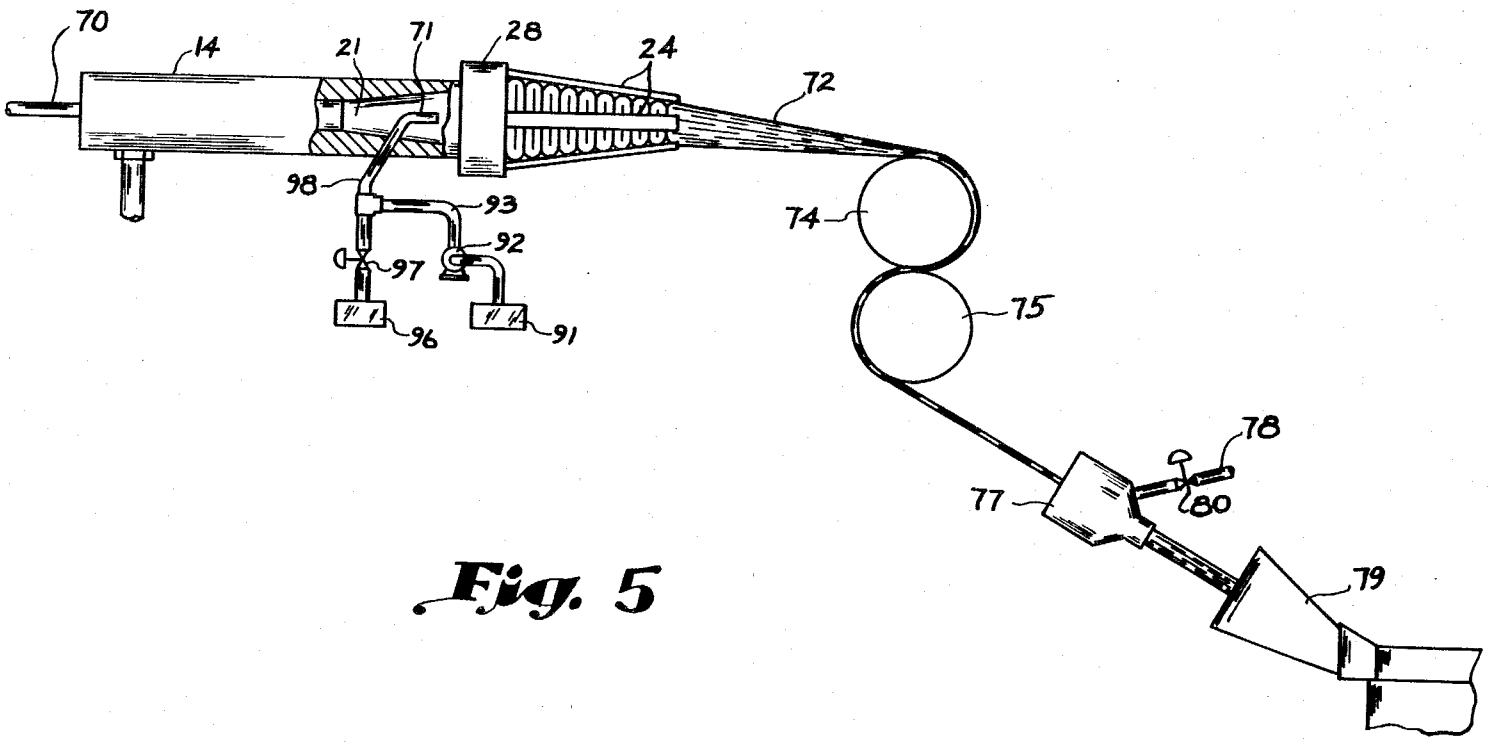
FIG. 5 is a side elevational view, partially in section, showing a preferred tow processing arrangement.
Figure 5A:
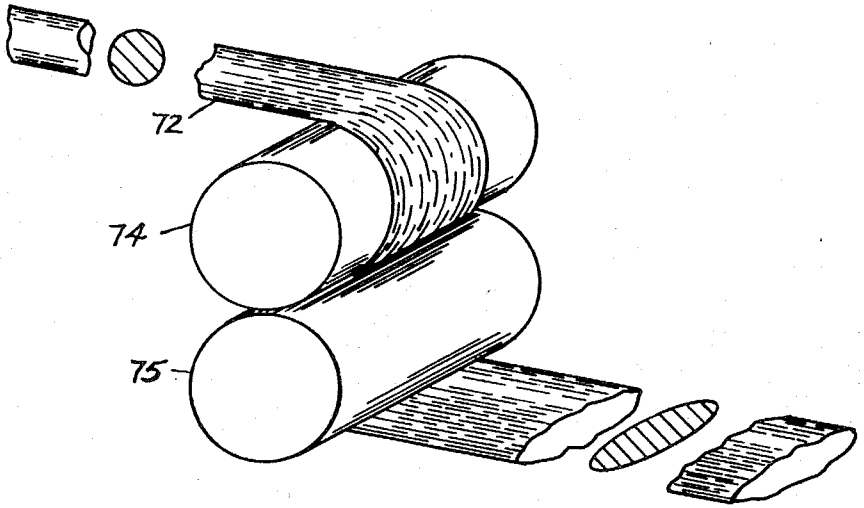
FIG. 5*a* is a perspective view, partially in section, of the filter tow and delivery rolls shown in the FIG. 5 tow processing arrangement.

A preferred tow processing arrangement is shown in FIG. 5 which permits the addition of flavoring or other additives to the interior portions of a bundle of filter tow as it moves through a blooming jet device. Filter tow 70 enters jet tube 14 where the tow is subjected to tension created by a rapidly moving stream of gaseous fluid. Additive is sprayed onto the interior portions of the filter tow by nozzle 71 which is concentrically positioned in passageway 21 of the jet tube. The bloomed and additive-treated tow 72 is withdrawn from discharge means 28 by cooperating delivery rolls 74 and 75 which compress the tow as it advances through the nip of the delivery rolls (see FIG. 5*a*). The filter tow then passes through stuffer jet 77 which is provided with conduit means 78 and valve 80 for introducing a gaseous fluid. The loosely compacted, rope-like filter tow emerging from stuffer jet 77 then enters the condensing horn 79 attached to conventional rod-forming means. This processing arrangement results in a formed filter rod having the additive applied by nozzle 71 concentrated largely along the longitudinal axis of the filter rod.

Figure 6:
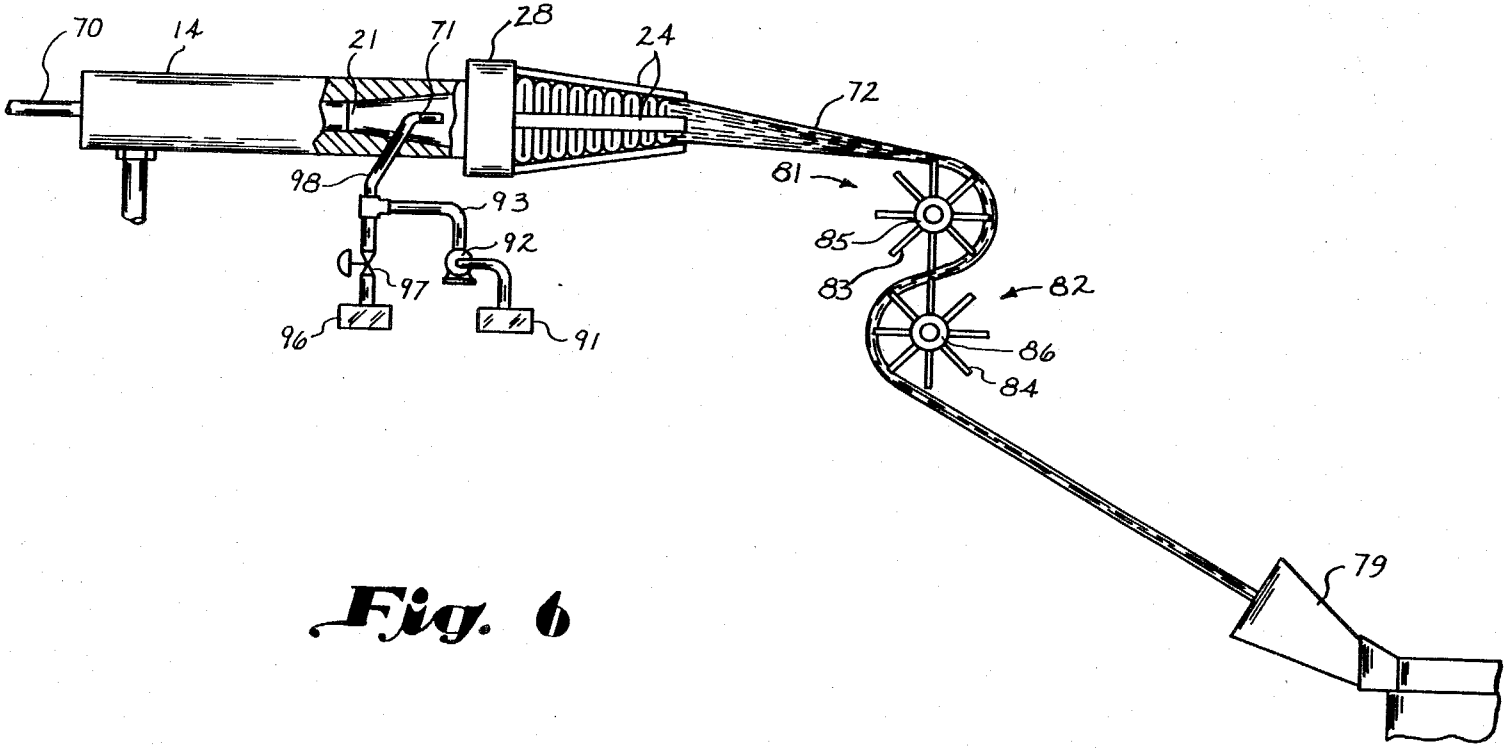
FIG. 6 is a side elevational view, partially in section, showing an alternative preferred tow processing arrangement.

An alternative preferred tow processing arrangement is shown in FIG. 6 which also leads to additive applied by nozzle 71 being concentrated along the longitudinal axis of the formed filter rod. In this arrangement delivery rolls 81 and 82 comprise a plurality of tow contacting members 83 and 84 attached to supporting shafts 85 and 86, respectively (see FIG. 6*a*). The tow-contacting members 83 and 84 are provided with indentations 83*a* and 84*a*, respectively, for engaging the filter tow and restricting its lateral movement as it traverses rolls 81 and 82. The conveyed tow passes directly into the condensing horn 79 of the rod-forming means.

Figure 5B:
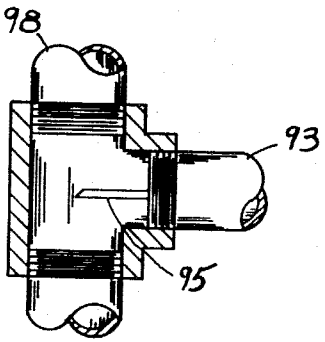
FIG. 5*b* is a side elevational view, partially in section, showing further details of the apparatus depicted in FIG. 5 for introducing additives into the jet device.

When applying flavoring material in liquid or solution form using the tow processing arrangements shown in FIGS. 5 and 6, it is preferred that the materials be introduced in the form of a gas-atomized spray and that the conduit carrying the flavoring materials from a supply source be provided with capillary tubing at the point where it is injected into the atomizing gas stream. The use of capillary tubing allows greater control over low flow rates of flavoring materials. Thus, flavoring materials from supply tank 91 are fed by pump 92 through conduit 93 and capillary tube 95 (see FIG. 5*b*) into conduit 98. Pressurized gas from gas supply 96 flows through valve 97 and into conduit 98 and carries the flavoring material to nozzle 71.

The following examples will further illustrate the advantages of the present invention.

EXAMPLE 1

The effectiveness of the present invention is demonstrated by treating cellulose acetate filter tow with plasticizer under different treatment conditions and forming the treated tow into a non-wrapped filter rod. The firmness of the resulting filter rod as well as the integrity of its outer peripheral surface are direct indications of plasticizer distribution in the filter tow. The filter tow treatment is carried out using apparatus which includes a first pair of feed rolls for withdrawing a bundle of filter tow from a supply bale via an intermediate tow spreading or banding jet and a guide roll, two wick-type applicators for applying plasticizer to each side of the spread band of tow, a blooming jet modified in accordance with the description which follows and a pair of delivery rolls for withdrawing the bloomed filter tow from the blooming jet and for conveying the tow via a stuffer jet to filter rod forming apparatus. The filter rod is formed without a paper wrap by heating the plasticized tow with steam while it is temporarily confined by a porous belt in the garniture section of the filter rod forming apparatus.

The blooming jet is provided with nozzle means similar to that shown in FIGS. 1 and 1*a* of the present disclosure and concentrically positioned within the frustum-shaped portion of the jet tube. The nozzle means comprises a metal tube approximately 6.5 mm in diameter that is sealed off at the end by a metal plug (e.g., solder). Approximately 7 mm from the sealed end two rows of 12 circumferentially arranged holes each about 0.8 mm in diameter are drilled into the wall of the metal tube. Installation of the nozzle means in the jet tube is facilitated by cutting through the jet tube transversely at the juncture of the cylindrical- and frustum-shaped portions of the passageway in the jet tube, drilling a suitable hole in the wall of the jet tube to accommodate the metal tube and reassembling the two sections of jet tube by means of a threaded coupling. Plasticizer is supplied to the metal tube and nozzle means via a valve which can be adjusted to control the quantity of plasticizer routed to the nozzle means. Downstream of this valve sufficient air under pressure is introduced into the plasticizer stream to produce atomization of the plasticizer as it emerges from the nozzle means.

The blooming jet is also provided with means for injecting controlled amounts of plasticizer into the air stream which enters the annular chamber (i.e., item 16 in FIG. 1) of the jet device. The conduit through which the air stream flows is provided with a T-joint adapted to receive a metal tube having a diameter of about 1.5 mm. The end of this metal tube is cut at a 45-degree angle and inserted into the T-joint so that the metal tube is perpendicularly positioned with respect to the air-supplying conduit and the 45-degree cut end of the tube is located at the diametrical center of the conduit about 15 cm. from the annular chamber. Plasticizer is supplied to the metal tube via a valve which can be adjusted to control the quantity of plasticizer directed through the metal tube.

In conventional tow processing apparatus, plasticizer is normally applied to each side of a flattened band of filter tow by two wick-type applicators with separate pumps supplying each applicator. For this experiment, tubing which supplies plasticizer to each of the two wick-type applicators is provided with first valve means for controlling plasticizer flow to the wicks and conduit means upstream of the first valve means for diverting plasticizer to the nozzle means associated with the blooming jet. By second valve means associated with probe 50 (FIG. 1) and third valve means associated with nozzle 60 (FIG. 1) together with the first valve means a substantially constant quantity of plasticizer is selectively routed to the wick-type applicators or probe 50 or nozzle 60. A quantity of triacetin plasticizer equivalent to approximately 8 percent by weight based on the weight of the tow is applied to the filter tow using four different modes of operation:

(a) Triacetin is applied solely by the two wick-type applicators in accordance with conventional processing technology.

(b) Triacetin is applied solely by the nozzle means 60 positioned within the frustum-shaped portion of the jet tube.

(c) Triacetin is applied solely by probe 50 positioned in the air-supplying conduit leading to the annular chamber in the jet device.

(d) Triacetin is applied by a combination of (b) and (c).

A non-wrapped cellulose acetate filter rod is formed by subjecting the plasticized tow from (a), (b), (c) and (d) to steam treatment under identical processing conditions. With pretreatment (a) the formed filter rod is poorly made and its peripheral surface is characterized by numerous loose and frayed strands of cellulose acetate fibers. A somewhat similar filter rod is produced using pretreatment (b). A filter rod with a uniform, smooth peripheral surface is produced from tow treated by (c) although the rod is rather soft. The use of mode (d) yields a filter rod that possesses a uniform, smooth peripheral surface as well as acceptable firmness when the triacetin is about equally divided between application points (b) and (c). From this experiment it is concluded that plasticizer can be applied to filter tow as it moves through the jet device of the present invention to give distribution of plasticizer on the tow that is comparable if not superior to that provided by conventional wick-type applicators.

EXAMPLE 2

A solution of flavoring agents in triacetin is applied to filter tow using a jet device and processing arrangement similar to that shown in FIG. 2 with the solution being applied solely by nozzle means concentrically positioned within the jet device and consisting of straight capillary tubing having an inside diameter of about 0.18 millimeter. A geared positive displacement pump is used to pump the triacetin/flavoring agent solution through a filter designed to remove particles greater than 40 microns in size with the filtered solution then being routed to the capillary tubing nozzle means where the solution is applied to the filter tow as it advances through the jet tube of the jet device. Air pressurized to 1400 grams per square centimeter is introduced into the conduit carrying the filtered triacetin/flavoring agent solution to the capillary tubing nozzle means to atomize the solution as it emerges from the nozzle means. The flow rate of the triacetin/flavoring agent solution is measured by a commercially available device designed for very low volume flows (e.g, flow meters based on mass flow or turbine flow principles). The treated filter tow is withdrawn from the jet device and immediately formed into filter rods using a conventional filter rod making machine which is operated at a tow speed of 400 meters per minute. The speed of the geared positive displacement pump is adjusted to give the desired quantity of triacetin/flavoring solution at the operating tow speed. Use of this filter tow processing arrangement permits the application of triacetin/flavoring solution flow rates as low as 0.75 milliliter per minute controllable within the range of 0.675 to 0.825 milliliter per minute.

EXAMPLE 3

A solution of flavoring agents in triacetin is applied to filter tow using a processing arrangement similar to that shown in FIG. 6 with the solution being applied solely by nozzle means concentrically positioned within the jet device. The construction of the jet device and associated nozzle means is similar to that shown in FIGS. 1 and 1*a* with the nozzle means being fabricated from 6.5-mm. diameter metal tubing. A geared positive displacement pump is used to feed the triacetin solution through a short section of capillary tubing having an inside diameter of 0.18 mm and into the 6.5-mm. diameter metal tubing which terminates in the nozzle means. This metal tubing is pressurized with air and is maintained at approximately 1400 grams per square centimeter to effect atomization of the solution as it emerges from the nozzle means. The speed of the positive displacement pump is regulated with respect to the speed of filter tow moving through the jet device to give an application rate of one milliliter of triacetin solution per 400 meters of filter tow.

Figure 6A:
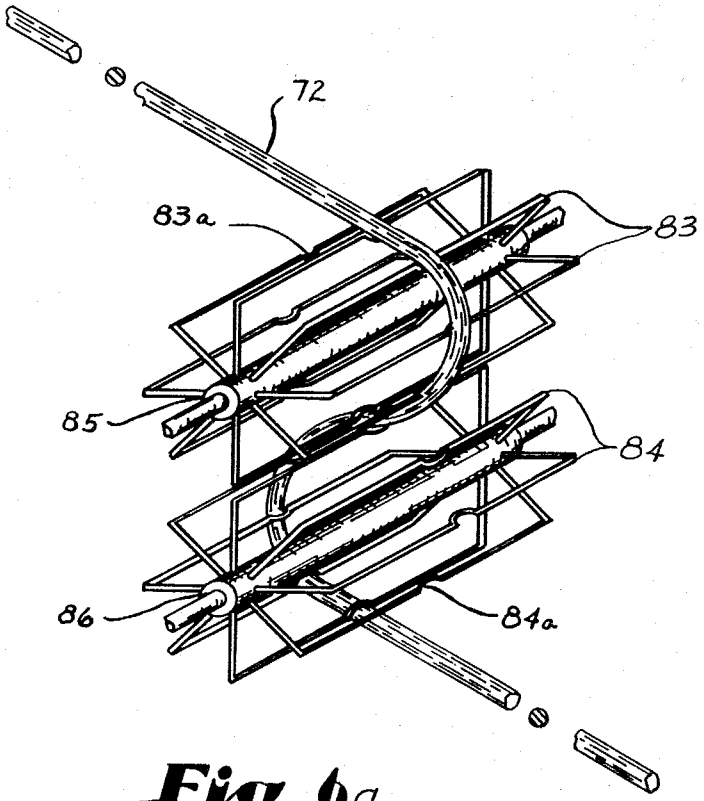
FIG. 6*a* is a perspective view, partially in section, of the filter tow and specially designed delivery rolls shown in FIG. 6.

The delivery rolls used to withdraw treated filter tow from the jet device and direct the tow to the inlet of the filter rod forming means are of special design similar to those shown in FIG. 6*a* except that each of the cooperating rolls comprises 12 tow-contacting members projecting radially outwardly from the supporting shaft. A further modification of the FIG. 6*a* design is that the cooperating rolls are positioned closer together and are maintained in proper registration which permits the tow-contacting members on one roll to project slightly into the space between adjacent tow-contacting members on the cooperating roll. Each tow-contacting member is constructed of heavy gauge wire and shaped so that the portion making actual contact with the filter tow is indented or recessed to restrict lateral movement of the filter tow as it traverses the delivery rolls. The indentations formed in each of the tow-contacting members have the shape of an elliptic arch and are in substantial alignment. The length of the indented portion of the heavy gauge wire is approximately 50 millimeters and the maximum depth of each indentation is 7 millimeters. The relative parallel positions of the delivery rolls is such that each tow-contacting member on one roll projects about 7 millimeters into the space between two adjacent tow-contacting members on the other delivery roll. Meshing gears affixed to each supporting shaft of the cooperating feed rolls maintain the delivery rolls in proper registration. The supporting shaft of one of the delivery rolls is provided with drive means interconnected with the filter tow transport apparatus delivering the tow into the jet device to assure a constant relationship between the tow speed upstream and downstream of the jet device. The treated filter tow withdrawn from the jet device is directed to the inlet of a KDF-II filter rod maker (manufactured by Hauni-Werke Korber & Co. of Hamburg, West Germany) without any substantial compression or flattening of the filter tow. Operating at a maximum tow speed of 400 meters per minute, filter tow is formed into a filter rod having satisfactory filtering and pressure drop characteristics. The triacetin solution of flavoring agents applied in this tow processing arrangement is concentrated almost exclusively in an area that coincides with the longitudinal axis of the formed filter rod as determined by red dye added to the triacetin solution for the purpose of visually observing the distribution pattern of the applied triacetin solution.

The foregoing description makes it apparent that the modified jet devices and processing arrangements of the present invention are capable of incorporating accurately controlled, effective amounts of additive into filter tow in addition to blooming the tow. Thus, this invention provides a more compact tow-treating apparatus and a greater degree of control over additive quantities and distribution than tow-treating apparatus that is currently used commercially. While examples of specific designs for jet devices and additive materials have been given, it is evident that additional variations and modifications can be made without departing from the spirit and scope of this invention. Any such variations and modifications are considered to fall within the scope of the appended claims.

What is claimed is:

1. A process for treating a continuous, multifilament filter tow in connection with the manufacture of filter elements therefrom which comprises (a) introducing said filter tow and a stream of gaseous fluid into a blooming jet device that includes an elongated filter tow passageway substantially circular in cross-sectional shape and provided with orifice means transversely positioned in said passageway, said orifice means being designed to accommodate passage therethrough of the filter tow and the gaseous fluid moving in co-current fashion, (b) applying an additive to the filter tow by primary nozzle means concentrically positioned with respect to the advancing filter tow in said passageway at a point that is downstream of said orifice means, (c) withdrawing the additive-treated filter tow from the blooming jet device by delivery roll means, and (d) advancing the additive-treated filter tow from said delivery roll means through a stuffer jet and into a condensing horn associated with filter rod-forming means.

2. The process of claim 1, wherein the additive is applied to the filter tow in the form of an aerated atomized spray.

3. The process of claims 1 or 2 wherein additional additive is applied to the filter tow by introducing said additional additive into the stream of gaseous fluid at a point upstream of said orifice means.

4. The process of claims 1 or 2 wherein additional additive is applied to the filter tow by secondary nozzle means positioned adjacent to the wall surface of the elongated filter tow passageway at a point that is downstream of said orifice means.

5. A process for treating a continuous, multifilament filter tow in connection with the manufacture of filter elements therefrom which comprises (a) introducing said filter tow and a stream of gaseous fluid into a blooming jet device that includes an elongated filter tow passageway substantially circular in cross-sectional shape, said jet device being designed to subject the filter tow to tension as the filter tow and gaseous fluid move in co-current fashion through said passageway, (b) applying an additive to the filter tow as it moves through the elongated filter tow passageway of the blooming jet device, (c) withdrawing the additive-treated filter tow from the blooming jet device by transport means adapted to engage the filter tow without compressing or flattening the filter tow between directly opposed tow-contacting surfaces, and (d) advancing the additive-treated filter tow into the condensing horn associated with filter rod-forming means.

6. The process of claim 5 wherein the additive is applied to the filter tow by primary nozzle means concentrically positioned with respect to the advancing filter tow in said elongated filter tow passageway.

7. The process of claim 5 wherein the filter tow and the stream of gaseous fluid are directed through orifice means transversely positioned in said elongated filter tow passageway.

8. The process of claim 7 wherein the additive is applied to the filter tow by secondary nozzle means positioned adjacent to the wall surface of the elongated filter tow passageway at a point that is downstream of said orifice means.

9. The process of claim 7 wherein the additive is applied to the filter tow by introducing the additive into the stream of gaseous fluid at a point upstream of said orifice means.

10. The process of claims 6 or 8 wherein the additive includes a flavoring agent and said additive is applied in the form of an aerated atomized spray.

11. A process for applying an additive to a continuous, multifilament filter tow in connection with the manufacture of filter elements therefrom which comprises passing the filter tow through a jet device that includes (a) a jet tube having entry and exit ends with an elongated passageway substantially circular in cross-sectional shape extending through the tube, said entry and exit ends being adapted to receive and discharge, respectively, said filter tow, (b) means for establishing and maintaining a high velocity stream of gaseous fluid through the jet device in the direction of said exit end of the jet tube, (c) orifice means transversely positioned in the elongated passageway and designed to accommodate passage therethrough of the gaseous fluid and advancing filter tow, (d) discharge means disposed at the exit end of the jet tube and designed to permit a sudden radially outward movement of the gaseous fluid and filter tow as they emerge from the exit end of the jet tube, and (e) tow confining means associated with said discharge means for limiting the radially outward movement of the filter tow, subjecting the filter tow while moving through said jet device to tension created by a high velocity stream of gaseous fluid moving through the jet device in co-current flow with the filter tow, applying an additive to the filter tow by nozzle means located in the jet tube downstream of said orifice means and concentrically positioned with respect to the advancing filter tow, and withdrawing treated filter tow from said jet device for further processing into filter elements.

12. The process of claim 11 wherein the additive is applied to the filter tow at a point intermediate said orifice means and said discharge means.

13. The process of claims 11 or 12 wherein the additive includes a flavoring agent and said additive is applied to the filter tow in the form of an aerated atomized spray.

* * * * *